US007762106B2

(12) United States Patent
Stingel

(10) Patent No.: US 7,762,106 B2
(45) Date of Patent: Jul. 27, 2010

(54) INTERNALLY GUIDED NEEDLE

(75) Inventor: Uwe Stingel, Meβstetten (DE)

(73) Assignee: Groz-Beckert KG, Albstadt (DE)

( * ) Notice: Subject to any disclaimer, the term of this patent is extended or adjusted under 35 U.S.C. 154(b) by 86 days.

(21) Appl. No.: 12/149,586

(22) Filed: May 5, 2008

(65) Prior Publication Data

US 2008/0271496 A1 Nov. 6, 2008

(30) Foreign Application Priority Data

May 3, 2007 (EP) ..... 07008924

(51) Int. Cl.
*D04B 15/00* (2006.01)

(52) U.S. Cl. ..... 66/115; 66/123

(58) Field of Classification Search ..... 66/116, 66/120, 204, 206, 203, 104
See application file for complete search history.

(56) References Cited

U.S. PATENT DOCUMENTS 1,385,929 A * 7/1921 Scott ..... 66/13
RE15,741 E * 1/1924 Scott ..... 66/13
2,913,888 A * 11/1959 Amidon ..... 66/204
3,301,014 A * 1/1967 Wiesinger ..... 66/115
3,664,155 A * 5/1972 Dalmau Guell ..... 66/115
3,783,646 A * 1/1974 Naumann et al. ..... 66/120
3,852,979 A 12/1974 Mühlhäusler
3,952,551 A * 4/1976 Kohl ..... 66/120
5,609,044 A * 3/1997 Tacy ..... 66/115
6,609,398 B2 * 8/2003 Plath ..... 66/120
6,925,841 B2 * 8/2005 Heydt, Jr. ..... 66/120

FOREIGN PATENT DOCUMENTS

DE 2 140 180 8/1971

* cited by examiner

*Primary Examiner*—Danny Worrell
(74) *Attorney, Agent, or Firm*—Fitch, Even, Tabin & Flannery; Norman N. Kunitz

(57) ABSTRACT

For longitudinal shifting, a needle in accordance with the invention is provided with a longitudinal slit 14 that is disposed to accommodate a bearing element (19), for example, having the form of a strip (20). Whereas known needles are set in a guide channel and thus are held or guided between two guide flanks, the needle in accordance with the invention extends around a strip (20) and is guided on said strip. Thus, the needle is guided on two surfaces of the guide element (19) and the strip (20), respectively, said surfaces facing away from each other. The support section (4) and the bearing element (19) form a highly precise positioning or guide device.

16 Claims, 3 Drawing Sheets

INTERNALLY GUIDED NEEDLE

CROSS-REFERENCE TO RELATED APPLICATION

This application claims the priority of European Patent Application No. 07 008 924.8, filed May 3, 2007, the subject matter of which, in its entirety, is incorporated herein by reference.

BACKGROUND OF THE INVENTION

The invention relates to a knitting tool for a textile machine for the production of knitted goods, in particular to a knitting machine as well as to a needle bed associated with said knitting tool.

Knitting tools are held in large numbers in appropriate needle beds in textile machines, for example in knitting cylinders or dials, in a manner so as to be respectively movable in longitudinal direction. For accommodation of the knitting tools, e.g., the needles, slits having a rectangular cross-section are provided in the corresponding beds, whereby the knitting tools are set in said slits. In order to create the slits, the dials and/or knitting cylinders are provided with grooves into which strips preferably consisting of thin sheet steel are inserted. The gaps existing between the strips then form the grooves accommodating the needles or other knitting tools. In order to reduce wear on the grooves or the strip walls, the inserted strips preferably are made of hardened sheet steel.

Such a knitting cylinder has been disclosed by DE Offenlegungsschrift 21 40 180.

In order to ensure that the two needle channel walls of a needle channel are parallel, the inserted strips are wedge-shaped. Therefore, the strips that are inserted in the dial are wedge-shaped in longitudinal direction, the strips that are inserted in the knitting cylinder are wedge-shaped in a direction transverse to the longitudinal direction. The manufacture of wedge-shaped strips is complex, especially since the pitch is a function of the diameter of the dial or of the knitting cylinder.

The manufacture of the strips displaying different pitches is complex and increases the manufacturing complexity of beds for knitting tools.

The object is to remedy this situation.

SUMMARY OF THE INVENTION

This object is achieved with the needle in accordance with Claim 1, as well as with a needle carrier in accordance with Claim 9:

The knitting tool in accordance with the invention, which may be, e.g., a knitting needle, has a longitudinal groove in its body, said groove being used to hold the knitting tool on a bearing element in a desired position. The desired position may be a position permitting a shifting of the needle in said needle's longitudinal direction. The bearing element thus supports the needle in the needle bed of a circular knitting machine or of a flat-bed knitting machine so that said needle can slide in longitudinal direction. The needle accommodates at least one section of the bearing element in its groove and thus rides on said bearing element. The bearing groove of the needle body is limited by two flanks or legs which accommodate the bearing element between them. In so doing, the needle is guided—with minimal play—in particular by the lateral surfaces of the bearing element that face away from each other. The bearing element provides the needle the required lateral guidance. While known knitting tools or needles are supported on their outside surfaces, the knitting tools in accordance with the invention are supported on at least two of their inside surfaces.

The bearing groove of the needle, which extends in longitudinal direction of the needle, extends preferably over at least one part of the length of the needle body. Preferably, in so doing, the bearing groove begins at a narrow side, for example, the needle back of the needle, and extends from there parallel to the flat sides of the needle body into said needle body. The needle back may be configured as a support surface so that the needle slides on the surface of the needle bed that exists between two adjacent bearing elements. In a simple manner, said bearing surface may be machined with the desired precision before the bearing elements are placed in the receiving grooves provided therefor. However, alternatively, it is also possible to configure the bottom of the bearing groove of the needle body as a support surface so that the needle back does not contact the needle bed.

The inventive design permits the construction of needle beds with a particularly small needle division. Adjacent needles may be arranged very closely next to each other, leaving only a minimal gap permitting the unimpaired movement of the needles. In particular in inoperative state of the needle assembly, for example on the bar of a knitting machine, the needles may also be in lateral contact with each other and thus support each other.

It is possible to configure the needle bodies with a uniform width along their entire length up to their hook. However, it is also possible to divide them into a support section with a slightly greater width and a stitch-forming section with a slightly smaller width. The latter is advantageous in particular when the needles are arranged very closely next to each other and when the needles are of a very fine gauge, i.e., are of minimal width. The support section of the needle body may have a greater width than the support section of a conventional needle having the same divisions. As a result of this, the needle foot is wider at the same time, thus reducing the wear of the foot. In so doing, the width is always to be measured as the distance of the two flat sides of the needle body that face away from each other, namely, in a direction transverse to the longitudinal direction of the knitting tool.

The support section and stitch-forming section may be seamlessly connected to each other in one piece and may consist of the same material. It is also possible to use an appropriate joining technique to connect the two sections with each other. Such a joining technique, for example, is welding. In this case, the manufacture of the two sections can be optimized regarding the choice of their material in a manner largely independent of each other.

It is also possible to connect the two sections with each other in a detachable manner. For example, if the stitch-forming section is worn, the stitch-forming section may be replaced while the support section will continue to be used.

A needle bed designed for the accommodation of a needle in accordance with the invention comprises at least one bearing element configured as a strip that fits into the bearing groove of the associate needle. Referring to needle cylinders, such strips are inserted into axis-parallel slits of the needle cylinder, said slits being arranged on the external circumference of the needle cylinder. By themselves, the strips have parallel flanks. Adjacent strips subtend an angle relative to the radical direction, preferably an acute angle.

Likewise, for supporting the needles on the dials, the dials are provided with strips extending in radial direction, said strips being configured with parallel flanks and subtending an acute angle in radial direction. While the needles may largely be in contact with each other at their ends close to the center, they are at a distance from each other at their ends remote from the center, i.e., at their hooks. Because of the absence of strips between the adjacent needles, it is possible to achieve a very tight division. In order to support the stitch-forming section(s) of the knitting tool, a needle slit having a conventional configuration may additionally be provided on the outer edge of the dial. If these slits are short in radial direction, tapered grinding of the corresponding strips is not necessary because of the already available play.

Considering the inventive bearing design, the strips to be inserted are configured parallel with respect to their flat sides. Inasmuch as the wedge-shaped configuration of the strips necessary in accordance with prior art is not necessary, the strips may be manufactured in a cost-effective manner.

In accordance with the invention, a considerable simplification of production and/or improvement of quality can be achieved in many applications.

The use of the needle bearing in accordance with the invention results, in a precise support of the needles, independently of the application (needle cylinder, dial, flat-bed knitting machine) The precision of the bearing specifically depends on the pairing of the bearing element and the needle. An operation with reduced needle play is possible, thus leading to precision in guiding.

Additional details of advantageous embodiments of the invention result from the drawings, the description or the claims. The description concentrates on essential aspects of the invention and miscellaneous situations. The drawings supplement the description and disclose additional details.

DETAILED DESCRIPTION OF THE INVENTION

Figure 1:
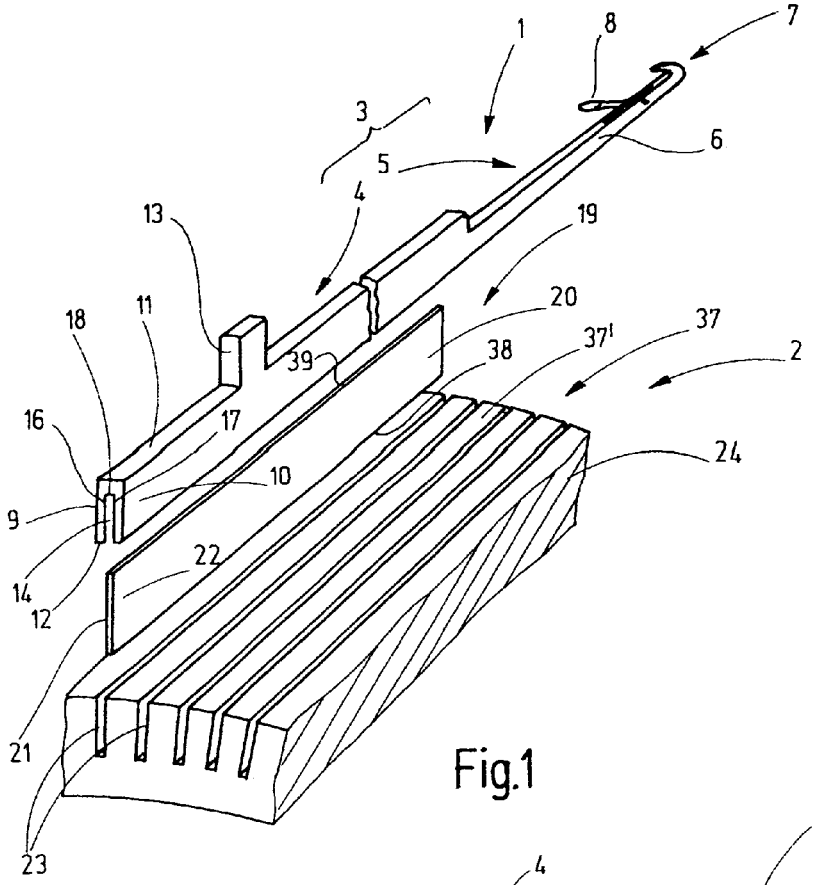
FIG. 1 is an exploded and schematic diagram of a needle cylinder with a needle and a bearing element.

FIG. 1 shows a needle 1 and an associate needle carrier in the form of a needle bed 2. For the purpose of illustration, the needle 1 is a latch-type needle. However, there may also be other knitting tools such as, for example, barbed needles, transfer needles, compound needles, cutting needles, a bar or the like. The needle has a needle body 3 which is divided into a support section 4 and into a stitch-forming section 5. Referring to the present exemplary embodiment, both form a seamless one-piece unit. Beginning at the bearing section 4, the stitch-forming section 5 extends—in a straight extension—as the shaft 6. On its end, the shaft 6 has a hook 7 and a closing member 8 for the hook 7, for example, in the form or a tongue, a slider or the like. In the form of a tongue, the closing member 8 is supported so as to be pivotable toward the hook 7 and away from said hook. Said tongue extends into a tongue slit extending through the shaft 6. However, applications in which the knitting tool 1 does not require a closing member 8 are conceivable.

The support section 4 preferably has an approximately rectangular cross-section that is limited by two flat sides 9, 10 and two narrow sides 11, 12. The flat sides 9, 10 are preferably flat surfaces that are oriented parallel to each other and face away from each other. The narrow sides 11, 12 form the needle's upper side 11 and the needle back 12. A foot 13 extends from the needle's upper side 11 and is disposed to drive the needle 1.

Figure 3:
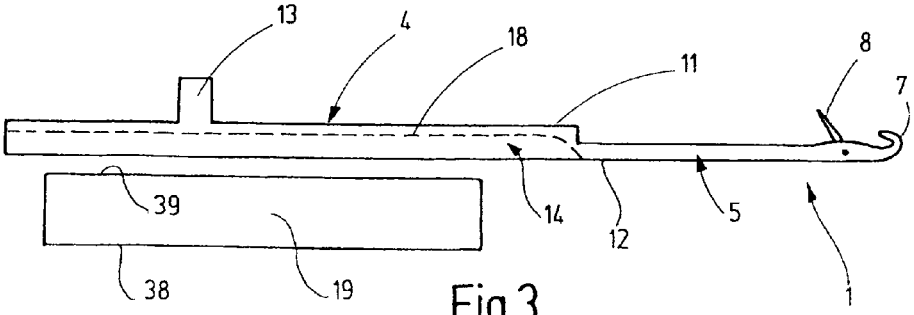
FIG. 3 is a side view of the needle and the bearing strip in accordance with FIG. 1.

One of the two narrow sides 11, 12—in the present case the needle back 12—is provided with a bearing groove 14 that is preferably configured as a narrow slit. This groove has flanks 16, 17 that face each other and a bottom 18. The flanks 16, 17 are preferably flat. As shown by FIG. 3, the bottom 18 may be curved on one end of the bearing groove 14. In addition, the bearing groove 14 may be open at the end, as is shown by FIG. 1.

FIG. 1 also shows that the cross-section of the support section 4 is a U-shaped profile that extends around a bearing element 19 having the form of a strip 20 (of a needle carrier 2) and accommodates said bearing element between its legs. The strip 20, for example, consists of a thin oblong ledge. This ledge or strip 20, which preferably consists of hardened steel has parallel lateral surfaces 21, 22 that face away from each other. This strip 20 is set into a corresponding groove 23 of the needle bed, said bed being configured as a needle cylinder 24 in the present exemplary embodiment. The needle cylinder 24 has a lateral surface 37 that is provided with a plurality of such grooves 23. These grooves 23 extend parallel to each other and parallel to the center axis of the cylinder. The lower narrow side 38 of the strip 20 interacts with the bottom of the groove 23 and is in abutment with said bottom. The strip 20 is limited by the upper narrow side 39. The grooves 23 of the needle cylinder 24 open radially toward the cylinder and, themselves, have parallel flanks. Inasmuch as the parallel-flanked strips 20 are inserted in the parallel-flanked grooves 23 of the needle cylinder 24, and inasmuch as the grooves 23 as well as the strips 20 are radially arranged on the lateral surface 37, the distance between the two adjacent lateral surfaces 21, 22 of two adjacent strips 20 enlarges starting from the lateral surface 37. In so doing, the distance is measured in a direction transverse to the longitudinal direction of the strips 20. The distance between two adjacent lateral surfaces 21, 22 of two adjacent strips 20 changes over the height of the strips 20 that are arranged above the lateral surface 37 and is greatest in the region of the upper narrow side 37. The lateral surface 37 of the needle cylinder has individual lateral surface segments 37' that are configured as support surfaces.

Figure 2:
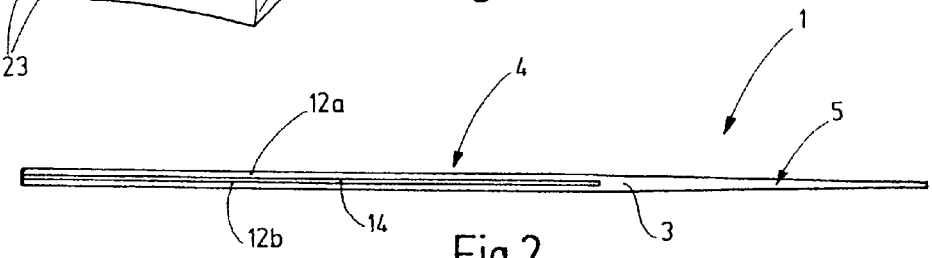
FIG. 2 is a rear view of the needle in accordance with FIG. 1.

FIGS. 2 and 3 are additional views of the needle 1. As is obvious, the support section 4 and the stitch-forming section 5 may have different heights that are to be measured between the narrow sides 11, 12. In addition, the width of the stitch-forming section 5 may decrease toward the hook 7. This may be achieved by one or more steps or by a gradual tapering, as indicated in FIG. 2. Also, the narrow side 12 formed on the needle back may be configured on both sides of the bearing groove 14 as a support surface 12*a*, 12*b*. These support surfaces 12*a*, 12*b* may interact with the lateral surface 37 or with the lateral surface segments 37'.

If the bearing element 19 of the needle carrier 2 and the bearing groove 14 of the knitting tool are configured in such a manner that the support surfaces 12*a*, 12*b* interact with the lateral surface segments 37', the upper narrow side 39 of the bearing element 19 is arranged at a distance relative to the bottom 18 of the bearing groove 14. It is also possible for the upper narrow side 39 of the bearing element 19 to be in abutment with the bottom 18 of the bearing groove 14, thus interacting therewith. In this case, the support surface 12, 12*a*, 12*b* is arranged at a distance from the lateral surface 38, 37', 37'. The knitting tool 1 then rides on the bearing element 19.

Each surface 9, 10, 11, 12 of a knitting tool 1 and each surface 21, 22 of a strip 20, or each surface 37 of a needle carrier 2, that interacts—during the movable positioning—may be provided with wear-inhibiting metal (e.g., chromium) or organic coatings (e.g., Teflon) having a pre-specified area profile and, optionally, a pre-specified peak-to-valley height.

The needle cylinder 24 described so far is manufactured, loaded and used as follows:

First, an appropriate cylindrical ring is provided with grooves 23 that are disposed to accommodate the strips 20. The outer circumferential surface of the needle cylinder 24 is fine-machined. This surface has the desired surface quality in order to be able to support and bear the support surfaces 12*a*, 12*b*. Now the strips 20 are set into the grooves 23 and fixed in position therein. Once this has been done, the needle cylinder 24 is essentially completed.

For operation, the needle cylinder 24 is positioned in a circular knitting machine and provided with the needles 1. To achieve this, the support sections 5 of said needles are set on the respective strip 20 until the support surfaces 12*a*, 12*b* abut against the needle cylinder 24. A more or less large distance exists between adjacent needles 1, so that adjacent needles 1 do not hinder each other in their longitudinal movement. The lock of the knitting machine that is in engagement with the feet 3 of the needles 1 extends around the outside circumference of the needles 1. During operation, a relative rotation between the needle cylinder 24 and the needle lock is achieved. Curved surfaces that are in abutment with the narrow sides of the feet 13 then impart the needles 1 with an axial motion. In so doing, the bearing elements 19 of the knitting cylinder 24 define the position of the needles 1 relative to the circumferential direction of the needle cylinder 24. Radial positioning is taken over by the support surfaces 12*a*, 12*b* of the knitting tool 1. Axial positioning is achieved by the feet 13.

The bearing groove 14, which is aligned so as to be centered relative to the longitudinal axis of the needle, and the strip 20 form a linear guide arrangement for the needle 1, said needle's precision having been established independent of the specific situation on the needle bed 2. In so doing, it is also not important whether or not the needle 1 and its associate bearing element 19 are arranged on a needle cylinder 24 in accordance with FIG. 1 or on a different type of needle bed 2, for example a dial 25 in accordance with FIG. 4. Again, the needles 1*a* are provided, said needles largely corresponding to the needles 1 in accordance with FIG. 1. However, the stitch-forming section 5 is narrower than the support section 4. The transition may be provided on the flat sides 9, 10 by providing steps in the transition from the support section 4 to the stitch-forming section 5.

Figure 4:
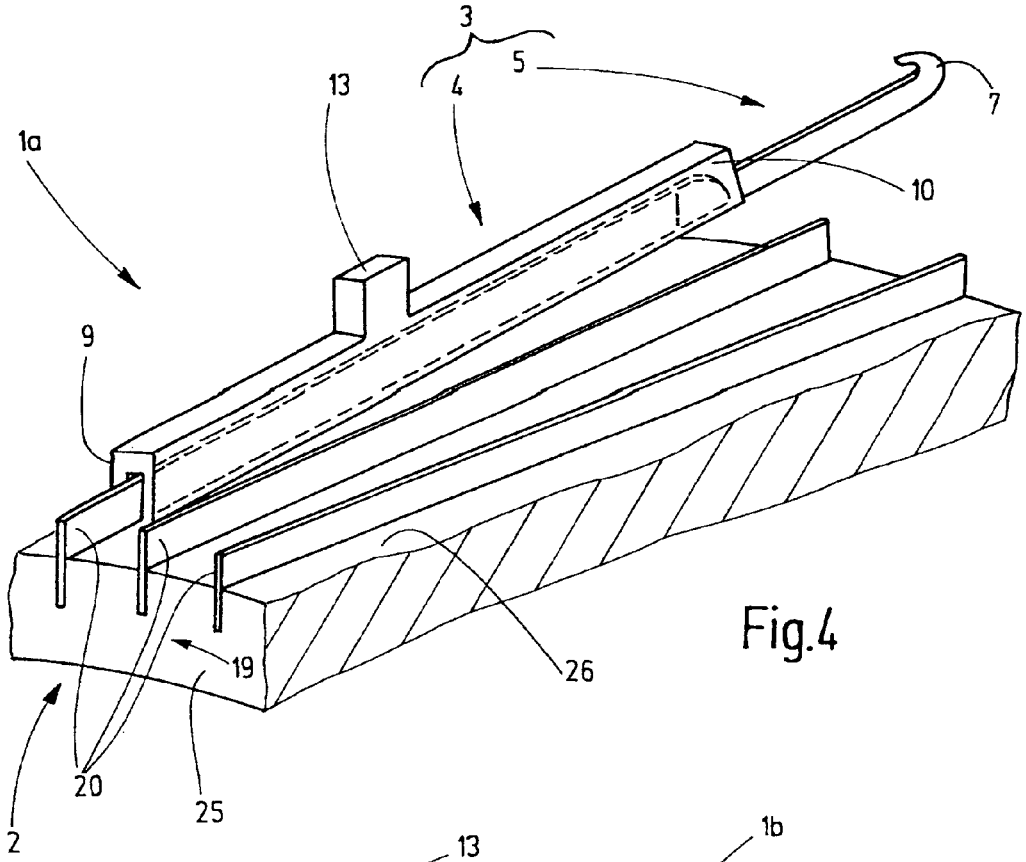
FIG. 4 is a perspective general arrangement drawing of a dial with a needle.

As is further shown by FIG. 4, the strips 20 are positioned on a planar surface 26 of the dial 25 at an acute angle relative to each other. The strips are at a distance from each other so that a channel is formed between them. The distance A between adjacent strips 20 increases, starting from the center toward the outer edge of the dial 25. This distance A is the greatest on the outer edge of the dial 25 that is arranged in the direction of the hook 7 or the knitting tool. The distance is measured parallel to the planar surface 26 of the dial 25. The strips 20 are not wedge-shaped but have parallel flanks, thus making a simple manufacture possible.

Figure 6:
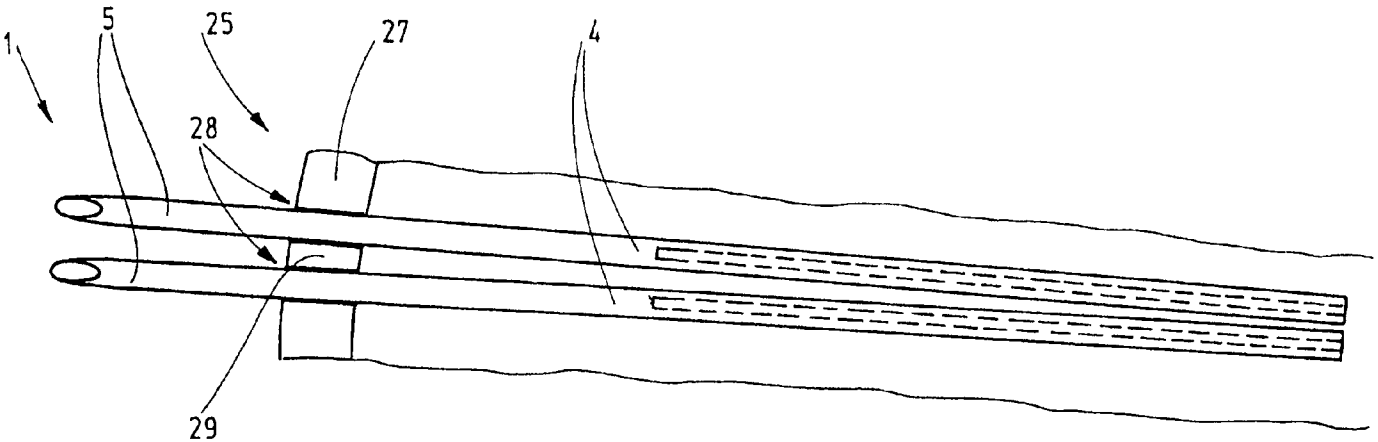
FIG. 6 is a plan view of a detail of a general arrangement drawing of a modified embodiment of a dial with needles.
Figure 7:
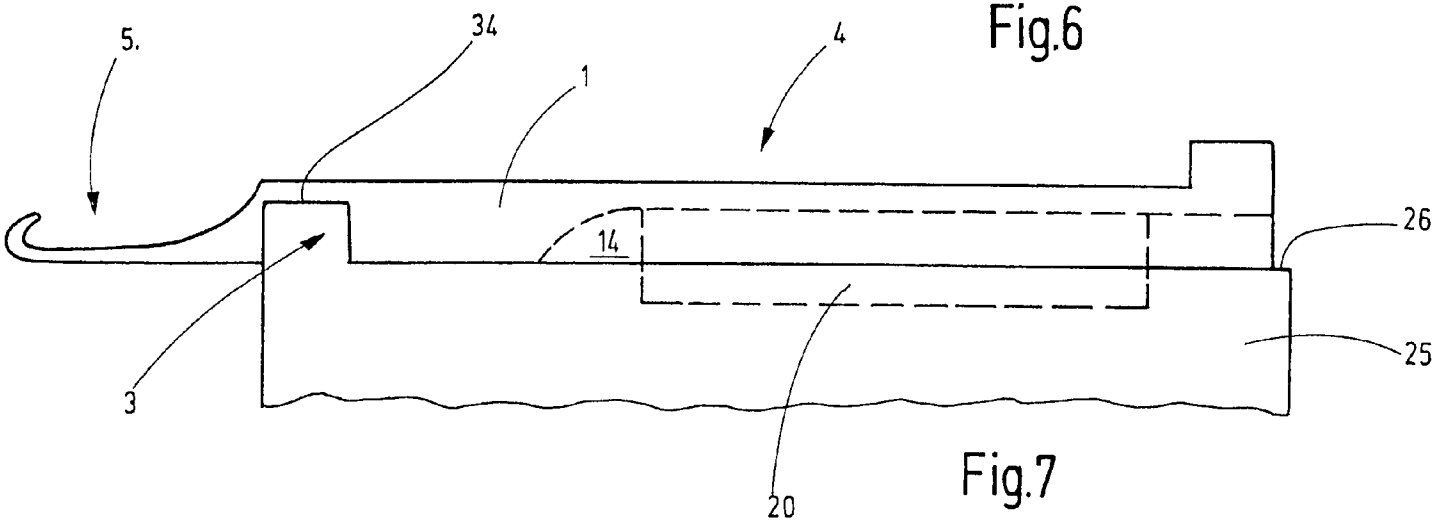
FIG. 7 is a view, radially in section, of the dial in accordance with FIG. 6.

Referring to the exemplary embodiment in accordance with FIG. 1, as well as to the exemplary embodiment in accordance with FIG. 4, the needles 1 and 1*a*, respectively, are exclusively guided—at least in the lateral direction—by the bearing elements 19 and by the strips 20, respectively. As is shown by FIG. 6, it is also possible, however, to supplement the inventive way of guiding needles by means of the bearing groove 14 and the bearing element 19 by providing an additional needle guide that is located, for example, in the outside region 27 of a dial 25. The outside region 27 is a radial, external section of the dial 25, for example an edge 33 provided with needle guide slits 28. The edge 33 is limited by a flat side 34, as is obvious from FIG. 7. This flat side 34 is arranged at a distance from the planar surface 26. The edge 33 that projects beyond the planar surface 26 of the dial 26 has cutouts in the form of slits 28 that are limited by the flat sides 35 and 36. These slits are made so as to have parallel flanks. The width of these slits 28 may be greater than the width of the knitting tool 1, because the knitting tools—during operation—are supported only on one flat side 35 or 36. The rotation of the dial in operative state is indicated by an arrow in FIG. 6. Due to the forces of rotation based on this direction of rotation, the knitting tools 1 are in contact with the flat side 35. If the dial rotates in the opposite direction, the knitting tools 1 are in contact with the flat side 36. This additional guiding of the needle permits the design of a relatively short bearing element 19. The introduced design can be used with needles 1 having a support section 4 and a stitch-forming section 5 with the same width, as well as with needles having a support section 4 and a stitch-forming section 5 with different widths.

Figure 5:
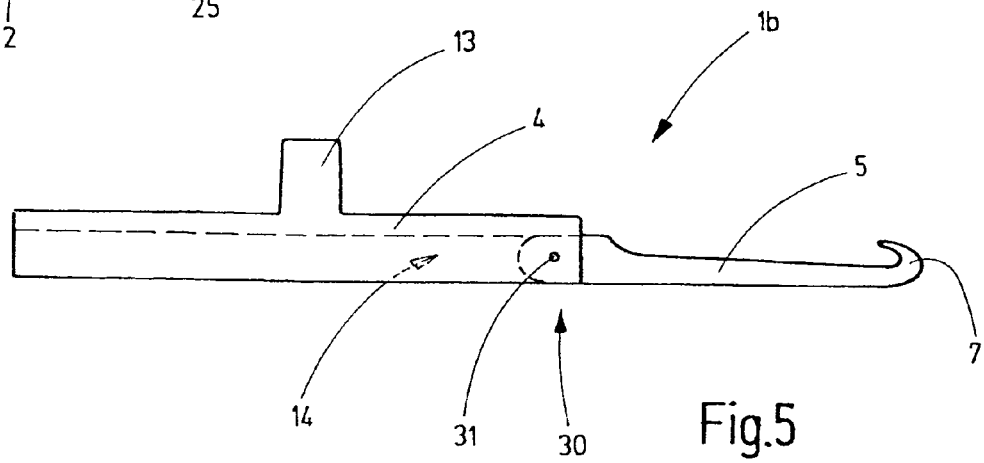
FIG. 5 is a general arrangement drawing of a modified embodiment of a needle in accordance with the invention.

FIG. 5 shows another modification of the inventive needle, i.e., needle 1*b*. Referring to this needle, the support section 4 and the stitch-forming section 5 are connected to each other at a joint site 30. For example, the support section 4 and the stitch-forming section 5 are joined to each other by a blunt-welded seam. However, it is also possible (not illustrated) that the stitch-forming section 5 extends into a cutout of the support section 4, for example, into its bearing groove 14. There, it may be connected to the flanks of the support section 4. For joining, substance-closed or force-closed connections or a combination thereof may be used. For example, this connection may be an adhesive connection, a welding connection such as, for example a welding spot 31 as is indicated in FIG. 5, or an embossed point. Instead of the welding spot, it is also possible to use a screw or the like that extends transversely through the support section 4 and the stitch-forming section 5 and forms a connection that allows said sections to be detached from each other.

The stitch-forming section 5 may have a width that corresponds to the width of the bearing groove 14. However, said stitch-forming section may also be somewhat wider than the bearing groove 14. For connection with the support section 4, it then has a slightly thinner section that extends into the bearing groove 14. Alternatively, the bearing groove 14 may then be widened on its end for the accommodation of the stitch-forming section 5.

Additional applications are possible for the needle in accordance with the invention. The knitting tools 1 may be arranged in such a manner that adjacent knitting tools 1 are in contact with the flat sides 9, 10. The flat side 9 of a first needle then contacts the flat side 10 of an adjacent needle. Optionally, a lubricant between adjacent knitting tools is helpful because two adjacent knitting tools 1 may move relative to each other. This lubricant may be of a metallic, e.g., chromium, or an organic nature. If the knitting tools are positioned so close to each other that they support each other on their flat sides, the overall stability of the knitting tool assembly is improved during operation.

In order to leave a free space between adjacent hooks 7 and adjacent stitch-forming sections 5 of adjacent knitting tools 1, into which free space other knitting tools 1 may enter, the stitch-forming sections 5 are configured somewhat narrower than the support sections 4. If the stitch-forming sections 5 are relatively short and the support sections 4 are relatively long, and if these support sections extend beyond the bed 2 even in retracted position of the knitting tools, the knitting tools support each other outside the bed 2 in the region of the support section 4. As a result of this, a very fine needle carrier can be made available. Consequently, fine-meshed, fine textile goods can be manufactured.

For longitudinal shifting, a needle in accordance with the invention is provided with a longitudinal slit 14 that is disposed to accommodate a bearing element 19, for example, having the form of a strip 20. Whereas known needles are set in a guide channel and thus are held or guided between two guide flanks, the needle in accordance with the invention extends around a strip 20 and is guided on said strip. Thus, the needle is guided on two surfaces of the guide element 19 and the strip 20, respectively, said surfaces facing away from each other. The support section 4 and the bearing element 19 form a highly precise positioning or guide device.

It will be appreciated that the above description of the present invention is susceptible to various modifications, changes and modifications, and the same are intended to be comprehended within the meaning and range of equivalents of the appended claims.

LIST OF REFERENCE NUMBERS

1, 1*a*, 1*b* Needle
2 Needle carrier, needle bed
3 Needle body
4 Support section
5 Stitch-forming section
6 Shaft
7 Hook
8 Closing member
9, 10 Flat side
11, 12 Narrow side
12*a*, 12*b* Support surfaces
13 Foot
14 Bearing groove
16, 17 Flanks
18 Bottom
19 Bearing element
20 Strip
21, 22 Lateral surfaces
23 Groove
24 Needle cylinder
25 Dial
26 Planar surface
27 Outside region
28 Needle guide slit
29 Strip walls
30 Joint site
31 Welding spot
32 Needle bar
33 Edge
34 Narrow side
35,36 Flat side
37, 37' Lateral surface, segment of the lateral surface
38 Lower narrow side
39 Upper narrow side

What is claimed is:

1. Needle bed for at least one needle having a needle body provided with a bearing groove by which said needle body is held or guided in a desired position on a bearing element, said needle bed comprising a strip for supporting the needle and constituting said bearing element, said strip being configured so as to immerse into the bearing groove of the needle in order to support said needle.

2. Needle bed in accordance with claim 1, wherein the needle body has two flat sides which are aligned parallel to each other and adjoin two narrow sides whereby the bearing groove, starting from one of the narrow sides, extends parallel to the flat sides into the needle body.

3. Needle bed in accordance with claim 1, wherein the bearing groove has flanks parallel to each other.

4. Needle in accordance with claim 1, wherein the bearing groove has support surfaces.

5. Needle bed in accordance with claim 1, wherein the needle body has a stitch-forming section and a support section, both having a matching width.

6. Needle bed in accordance with claim 1, wherein the needle body has a stitch-forming section and a support section, and the support section has a greater width than the stitch-forming section.

7. Needle bed in accordance with claim 1, wherein the needle body has a stitch-forming section and a support section which are connected to each other by a joining technique.

8. Needle bed in accordance with claim 1, wherein the needle body has a stitch-forming section and a support section, said sections being detachably connected to each other.

9. Needle bed in accordance with claim 1, wherein the strip is designed with parallel flanks.

10. Needle bed in accordance with claim 1, wherein the strip has an upper narrow side, the bearing groove has a bottom, and the narrow side is in contact with the bottom.

11. Needle bed in accordance with claim 1, wherein the strip is limited by parallel lateral surfaces, and the distance between the lateral surfaces of adjacent strips changes over the height of the strips.

12. Needle bed in accordance with claim 1, wherein the strip is limited by parallel lateral surfaces, and the distance between the lateral surfaces of adjacent strips changes over the length of the strips.

13. Needle bed in accordance with claim 12, wherein the needle bed has a planar outer surface and the strips project outwardly from the planar surface.

14. Needle bed in accordance with claim 11, wherein the needle bed has a cylindrical outer surface, and the strips project outwardly from the cylindrical surface.

15. Needle bed in accordance with claim 1, wherein said strip is mounted in a groove formed in an outer surface of the needle bed.

16. Needle bed in accordance with claim 15, wherein the needle bed has a plurality of said strips, each for supporting a respective needle and each mounted in a respective groove formed in the outer surface of the needle bed.

* * * * *